US009362642B2

(12) United States Patent
Kim et al.

(10) Patent No.: US 9,362,642 B2
(45) Date of Patent: Jun. 7, 2016

(54) FLEXIBLE CABLE CONNECTOR

(71) Applicant: Molex Incorporated, Lisle, IL (US)

(72) Inventors: Suk Min Kim, Ansan (KR); Kwan Yeong Hwang, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/702,829

(22) Filed: May 4, 2015

(65) Prior Publication Data

US 2015/0318631 A1 Nov. 5, 2015

(30) Foreign Application Priority Data

May 2, 2014 (KR) ..... 10-2014-0053647

(51) Int. Cl.

| | |
|---|---|
| ***H01R 12/79*** | (2011.01) |
| ***H01R 12/88*** | (2011.01) |
| ***H01R 12/70*** | (2011.01) |
| ***H01R 12/71*** | (2011.01) |

(52) U.S. Cl.

CPC ..... *H01R 12/88* (2013.01); *H01R 12/7005* (2013.01); *H01R 12/718* (2013.01); *H01R 12/79* (2013.01)

(58) Field of Classification Search

CPC ..... H05K 3/365; H01R 12/79
USPC ..... 439/67, 77, 260, 495
See application file for complete search history.

(56) References Cited

U.S. PATENT DOCUMENTS

| | | | | |
|---|---|---|---|---|
| 4,252,389 | A * | 2/1981 | Olsson | H01R 13/193 439/259 |
| 4,334,728 | A * | 6/1982 | Reynolds | H01R 12/88 439/267 |
| 7,374,430 | B2 * | 5/2008 | Nagawatari | H01R 12/79 439/67 |
| 2006/0151210 | A1 * | 7/2006 | Hirai | H05K 3/365 174/495 |
| 2009/0137146 | A1 | 5/2009 | Wang et al. | |
| 2009/0137147 | A1 | 5/2009 | Yang et al. | |

FOREIGN PATENT DOCUMENTS

| | | |
|---|---|---|
| KR | 10-1170428 B1 | 8/2012 |
| KR | 10-1310138 B1 | 9/2013 |

* cited by examiner

*Primary Examiner* — Tulsidas C Patel
*Assistant Examiner* — Marcus Harcum
(74) *Attorney, Agent, or Firm* — James A. O'Malley

(57) ABSTRACT

Disclosed herein is a connector for contacting a flexible cable with a printed circuit board (hereinafter "PCB") that enables the connector to contact the flexible cable directly to the PCB without using a terminal as a medium. The connector includes a housing that is fixed to a PCB and forms an insertion space between it and the PCB, where into a flexible cable is inserted; and an actuator mounted rotatably on the housing that pushes downward on the top of the flexible cable inserted into the insertion space so as to put the conductor part of the flexible cable in direct contact with the conductor part of the top of the PCB.

24 Claims, 5 Drawing Sheets

FLEXIBLE CABLE CONNECTOR

RELATED APPLICATIONS

This application claims priority to Korean Application No. 10-2014-0053647, filed May 2, 2014, which is incorporated herein by reference in its entirety.

TECHNICAL FIELD

This invention relates to a connector for contacting a flexible cable with a printed circuit board (hereinafter "PCB"); more specifically, it relates to a flexible cable connector that puts the flexible cable in direct contact with the PCB without the medium of a terminal.

BACKGROUND ART

With the recent trend toward smaller and higher-performance electronic products, many electronic components are placed on PCBs, and consequently many signals are input and output in parallel. For the electrical contact with devices, flexible flat cables (FFC) and flexible printed circuits (FPC) are widely used, in which a plurality of electrical wires are brought together as a single cable.

The flexible cable connectors of the prior art comprised a housing, fixed to the PCB and molded from plastic; a terminal formed as a plurality of termini inserted into the housing from the back of the housing and fixed in place; and an actuator that fixes the flexible cable inserted into the front of the housing in place in the housing. Examples of prior art include Republic of Korea Registered Patent Gazette No. 10-1170428 (issued 2012 Aug. 7) and Republic of Korea Registered Patent Gazette No. 10-1310138 (issued 2013 Sep. 23).

The flexible cable connectors of the prior art, having this configuration, are designed so as to establish a connection between the flexible cable and the PCB mediated by the termini: the flexible cable is first inserted into the housing with the actuator in its open state, and then the flexible cable is put in contact with the termini when the actuator is closed. The housing is fixed to the PCB by means of a fitting nail.

In the case of a flexible cable connector of the prior art having the above-described configuration, the signal transmission architecture and overall connector architecture are complex, because the flexible cable is contacted to the PCB by the medium of the termini, and the housing is fixed to the PCB by a separate fitting nail. As a result, it is difficult to reduce product manufacturing costs and miniaturize products.

SUMMARY OF THE INVENTION

In one embodiment, the flexible cable connector of this invention comprises: a housing that is fixed to a PCB and forms an insertion space between it and the PCB, into which a flexible cable is inserted; and an actuator mounted rotatably on the housing that pushes downward on the top of the flexible cable inserted into the insertion space so as to put the conductor part of the flexible cable in direct contact with the conductor part of the top of the PCB. The material of the housing can be metal, and the actuator is closed by rotating toward the front of the housing and opened by rotating away from the front of the housing. Axle(s) can be formed on the part of the actuator that makes up the back end thereof when the actuator is closed, and part of the axle(s) push downward on the flexible cable when the actuator is closed, so as to push the cable into close contact with the PCB. On the part of the housing that covers the top of the insertion space, axle through-hole(s) can be formed from top to bottom so that the axle(s) can pass through; and on the top of the through-hole(s) of the housing and support beam(s) are furnished that provides elastic support by pressing downward on the axle(s). A plurality of axles and support beams can be respectively formed spaced apart from one another; each support beam provides elastic support individually to each axle. The insertion space can be open toward the front and back of the housing, and the flexible cable can be inserted via the open part of the insertion space. On the part of said housing located on the side opposite the direction in which the flexible cable is inserted a stopper part can be formed to restrict the insertion of the flexible cable.

The housing can include a lower surface part installed at an interval from the PCB and forming said insertion space in the space between it and the PCB, and having the axle through-hole(s) formed therein; an axle support part bent upward from the back end of the lower surface part so as to overlap with the lower surface part, the support beam(s) being formed on the end thereof; a soldering part wherein the back end of the lower surface part or part of the axle support part is separated and soldered to the PCB; a stopper part, formed by separating the back end of the lower surface part or part of the axle support part(s); and a fitting part that covers the side of the insertion space and is soldered to the PCB, formed as a single unit with both sides of the lower surface part respectively.

The housing can also include a lower surface part installed at an interval from the PCB and forming an insertion space in the space between it and the PCB, and having the axle through-hole(s) formed therein; an axle support part bent upward from the back end of the lower surface part so as to overlap with the lower surface part, the support beam being formed on the end thereof; a soldering part wherein the front end of the lower surface part is separated and soldered to the PCB; a stopper part, formed by separating the front end of the lower surface part; and a fitting part that covers the side of the insertion space and is soldered to the PCB, formed in a single unit with both sides of the lower surface part respectively.

As can be appreciated, the end(s) of the support beam(s) can be positioned facing the front of the housing, and on the front part of the axle through-hole(s), axle detachment prevention part(s) can be formed bent upward from the lower surface part so as to overlap it, thus preventing forward detachment of the axle(s).

The axle(s) of the actuator is formed with a shape that is long in the vertical direction and short in the front-back direction when the actuator is closed. On the housing, a rotation prevention structure can be furnished that prevents the actuator from rotating further than necessary toward the back of the housing when the actuator is opened. An outward-sloping guide part can be formed on the front end or back end of said fitting part, on the side where the flexible cable is inserted, so that the flexible cable can easily be inserted into the insertion space. On the front end of the lower surface part, an upward-sloping guide part can be formed so that the flexible cable can easily be inserted into the insertion space.

The following effects can be obtained from the flexible cable connector disclosed herein.

First, because it is configured so that the flexible cable is contacted directly with the PCB, without terminals, and no separate fitting nail is required, the signal transmission architecture and overall connector architecture can be simplified, and as a result, the product manufacturing costs can be reduced and the products miniaturized.

Second, because it is configured so that the support beam furnished on this housing presses independently on the axle of the actuator to provide support, and thereby a consistent contact pressure can be maintained for each pin of the PCB and the flexible cable, it can maintain a stable contact between the flexible cable and the PCB. In particular, because identical reliability of contact can be ensured at either end and in the center, even as the number of pins in the PCB and flexible cable increase, the contact status thereof can be kept consistent (i.e. it can be applied over a wide range of cases, from few pins to many pins).

DETAILED DESCRIPTION OF THE PREFERRED EMBODIMENTS

Described below are preferred embodiments of the flexible cable connector of this disclosure and they will be described in detail with reference to the attached drawings. The purpose of this invention, which has been devised in order to address the above-described problems of the prior art, is to provide a flexible cable connector that can simplify the signal transmission architecture and overall connector architecture. Although only an FPC will be described in these embodiments, by way of example of a flexible cable, the flexible cable used is not limited thereto, and other flexible cables such as FFCs can also be used.

Figure 1:
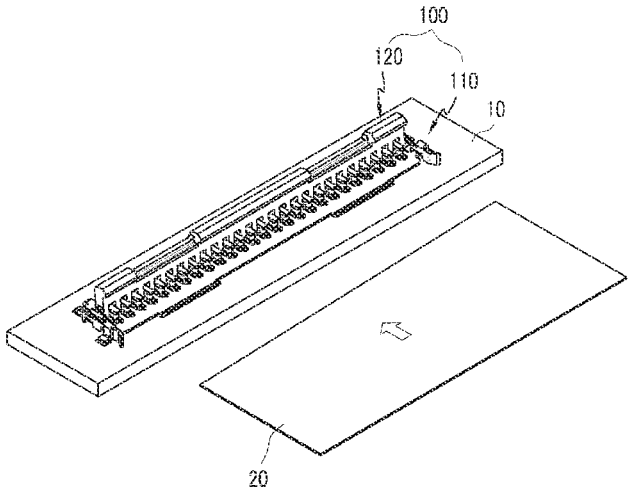
FIG. 1 is an oblique view of the flexible cable connector of this invention according to Embodiment 1, for insertion of an FPC.
Figure 2:
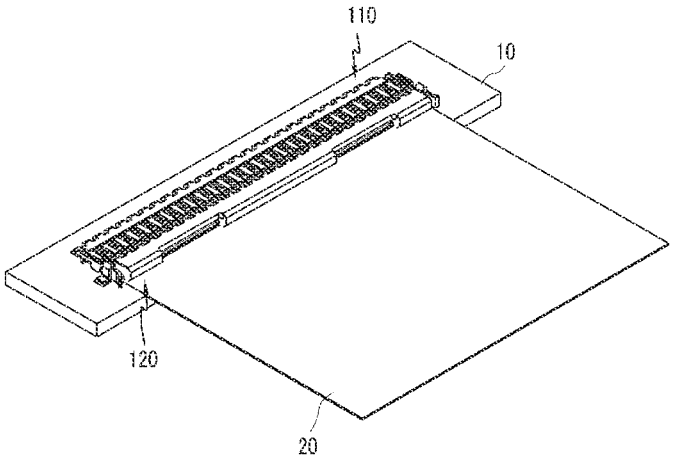
FIG. 2 is an oblique view of an FPC having been fully inserted into the flexible cable connector of this invention according to Embodiment 1.

FIG. 1 is an oblique view of the flexible cable connector of this invention according to Embodiment 1, for insertion of an FPC; FIG. 2 is an oblique view of an FPC having been fully inserted into the flexible cable connector of this invention according to Embodiment 1.

The flexible cable connector (100) according to this embodiment comprises: a housing (110) that is soldered to a PCB (10) and forms an insertion space between it and the PCB (10) into which an FPC (20) is inserted; and an actuator (120) that is mounted rotatably on the housing (110) so as to press down on the top surface of the FPC (20) inserted into the insertion space so as to establish a direct contact between the FPC (20) and the PCB (10). Here the housing (110) is a metal shell of a metallic material.

The flexible cable connector (100) according to this embodiment has a front-flip type structure; the actuator (120) is closed by rotating toward the front of the housing (110), and the FPC (20) is inserted via the front of the housing (110). The actuator (120) is opened by rotating in the direction away from the front side of the housing (110).

As shown in FIG. 1, when the actuator (120) has been opened, the FPC (20) is inserted into or removed from the insertion space via the front of the housing (110). The actuator (120) is vertical when opened.

As shown in FIG. 2, after the FPC (20) has been fully inserted into the insertion space, if the actuator (120) is closed by rotating it toward the front of the housing (110), the FPC (20) is then firmly fixed in place within the insertion space, and the FPC (20) is brought into close contact with the top surface of the PCB (10) as each of its contact pins are brought into direct contact.

Figure 3:
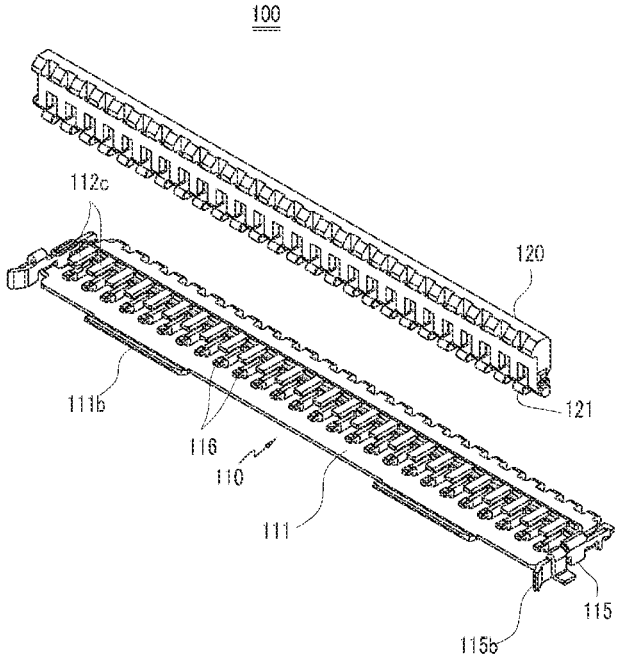
FIG. 3 is an exploded oblique view of the flexible cable connector of this invention according to Embodiment 1.
Figure 4:
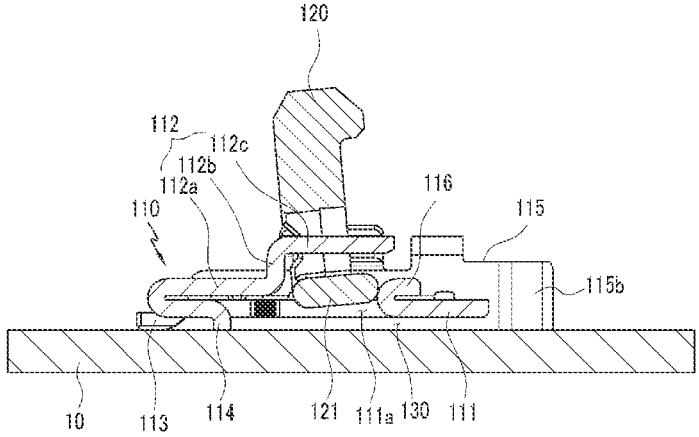
FIGS. 4 through 6 are cross-sections showing the process of the FPC being inserted.
Figure 5:
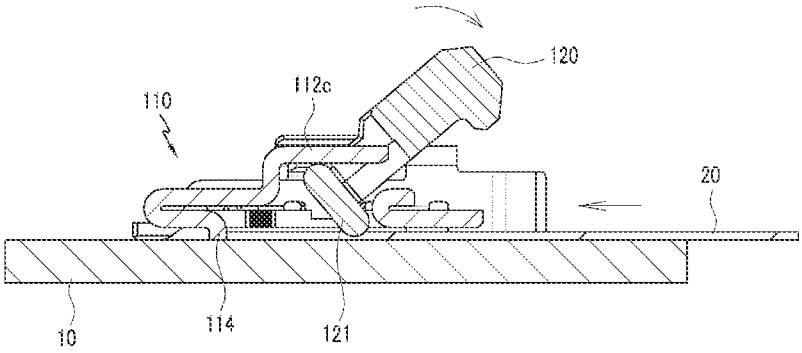
Figure 6:
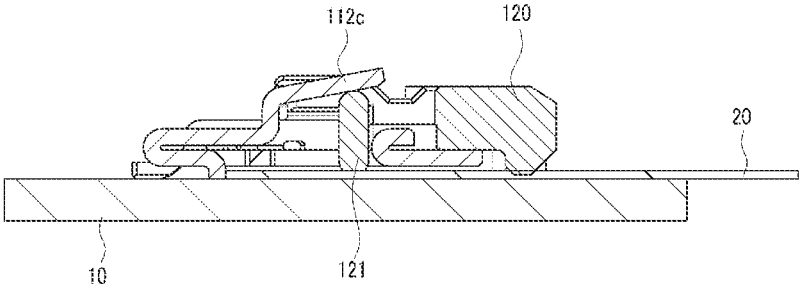

FIG. 3 is an exploded oblique view of the flexible cable connector of this invention according to Embodiment 1; FIGS. 4 through 6 are cross-sections showing the process of the FPC being inserted.

The flexible cable connector (100) of this invention comprises a housing (110) formed of metal, and an actuator (120) formed of an insulator such as plastic. The housing (110) comprises a lower surface part (111), axle support part (112), soldering part (113), FPC stopper part (114), fitting part (115), and axle detachment prevention part (116). Axles (121) are furnished in the actuator (120).

A lower surface part (111) is installed at an interval above the PCB (10), and forms an insertion space (130) between it and the PCB (10), into which the FPC (20) is inserted. On the lower surface part (111), a plurality of axle through-holes (111*a*) are formed, spaced apart to left and right in the same number as the axles (121), so that the axles (121) of the actuator (120) can be inserted thereinto and rotated therewithin. The insertion space (130) of the housing (110) is open to the front.

The axle support parts (112) extend from the rear of the lower surface part (111), and are bent so as to overlap the lower surface part (111) so as to elastically support the axles (121) of the actuator (120). The ends of the axle support parts (112) are positioned facing toward the front of the housing (110). The axle support parts (112) comprise an extension part (112*a*) that extends from the back end of the lower surface part (111) and are bent so as to overlap the lower surface part (111); a vertical part that is bent vertically upward from the end of the extension part (112*a*); and a support beam (112*c*) that is bent horizontally forward from the top end of the vertical part (112*b*) so as to push against and support the axle (121). A plurality of support beams (112*c*) are formed spaced apart to left and right, positioned above each axle through-hole (111*a*). Due to the bending structure of this axle support part (112), the support beam (112*c*) possesses elasticity, and each support beam (112*c*) individually provides elastic support to the axle (121).

The soldering part (113) is formed separately from the back end of the lower surface part (111) and is soldered to the PCB (10).

The FPC stopper part (114) is formed separately extending downward from the lower surface part (111) so as to cover the rear side of the insertion space (130) and restrict the insertion of the FPC (20).

A plurality of soldering parts (113) and FPC stopper parts (114) are formed and positioned alternating with one another. The soldering parts (113) and FPC stopper parts (114) are formed separately from the lower surface part (111), but are not limited thereto, and may also be formed separately from the axle support part (112).

The fitting part (115) is formed extending to either side of the lower surface part (111) as a single unit, so as to be soldered to the PCB (10) and cover the sides of the insertion space (130).

The axle detachment prevention part (116) extends from the lower surface part (111) in front of the through-holes (111*a*), and is bent so as to overlap the top of the lower surface part (111) so that it prevents forward detachment of the axles (121). Because the axle detachment prevention part (116) is formed protruding above the top surface of the lower surface part (111), when the axle (121) of the actuator (120) is rotated within the axle through-hole (111*a*), the axle (121) catches on it and therefore cannot detach toward the front. Because the bent part of the axle detachment prevention part (116) forms a curve, when the axle (121) is rotated, it can rotate smoothly without damage.

On the front end of the lower surface part (111) that makes up the housing (110), a guide part (111*b*) is formed, sloping upward in an oblique direction, that guides the FPC (20) so that it can be easily inserted; likewise, on the front end of the fitting part (115), a guide part (115*b*) is formed, sloping outward, that guides the FPC (20) so that it can be easily inserted.

On the part of the actuator (120) that makes up the back end thereof when it is closed, a plurality of axles (121) are formed spaced apart from one another; when the actuator (120) is closed, some of the axles (121) push the FPC (20) downward to establish close contact with the PCB (10). The axles (121), as shown in FIG. 6, are formed in a shape that, when the actuator (120) is closed, is long in the vertical direction and short in the front-back direction. As a result, as shown in FIG. 6, when the axles (121) are closed, the long part is vertical and pushes on the FPC (20); and as shown in FIG. 4, when they are open, the long part becomes horizontal and the force that had been pushing on the FPC (20) is released, and it becomes possible to insert or remove the FPC (20).

When the actuator is opened (120) and enters the vertical position, the part formed between the axles (121) on the back end of the actuator (120) is inserted between the support beams (112*c*) so as to catch on the part where the support beams (112*c*) are formed, so as to prevent rotation further back than the open state of the actuator (120).

The process of inserting an FPC (20) into a flexible cable connector (100) of this invention, having the above-described configuration, will now be described with reference to FIGS. 4 through 6.

As shown in FIG. 4, when the actuator (120) is in vertical position, the long parts of the axles (121) are in a horizontal position within the axle through-holes (111*a*), and the insertion space (130) is entirely open.

As shown in FIG. 5, the FPC (20) is inserted into the insertion space (130) via the front of the housing (110), and the front end of the FPC (20) is inserted until it cannot be inserted any further due to contacting the FPC stopper part (114). When the FPC (20) has been fully inserted, the actuator (120) is rotated toward the front of the housing (110). In this process, the axles (121) of the actuator (120) rotate while being supported by the support beams (112*c*) of the axle support parts (112) so that they cannot detach upward. The support beams (112*c*) possess elasticity and therefore are not damaged and are lifted upward.

As shown in FIG. 6, when the actuator (120) is completely closed, the long parts of the axles (121) become vertical, and one end of the long part pushes on the top surface of the FPC (20), while the other end is contacted and pushed by the support beam (112*c*). The axles (121) are pushed downward by the elastic force of the support beams (112*c*), so that the FPC (20) is in close contact with the top surface of the PCB (10), which causes the contact pins of the FPC (20) to come into direct contact with the contact pins of the PCB (10).

Figure 7:
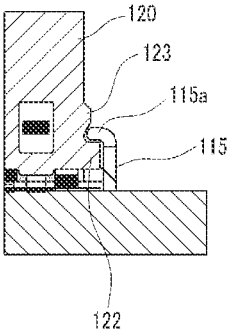
FIG. 7 is a cross-section showing the coupling relationship between the actuator and the fitting nail shown in FIG. 3.

FIG. 7 is a cross-section showing the coupling relationship between the actuator and the fitting nail shown in FIG. 3.

On the top of the fitting part (115), a tab (115*a*) is formed, bent toward the actuator (120), that prevents the sides of the actuator (120) from being lifted upward. A blocking part (122) protrudes below the tab (115*a*) on either side of the actuator (120). Rotation prevention blocks (123) are formed spaced apart from the blocking parts (122) on either side of the actuator (120), so that when the actuator (120) has been placed in vertical position, they will catch on the tab (115*a*) and prevent undesired rotation of the actuator (120).

Figure 8:
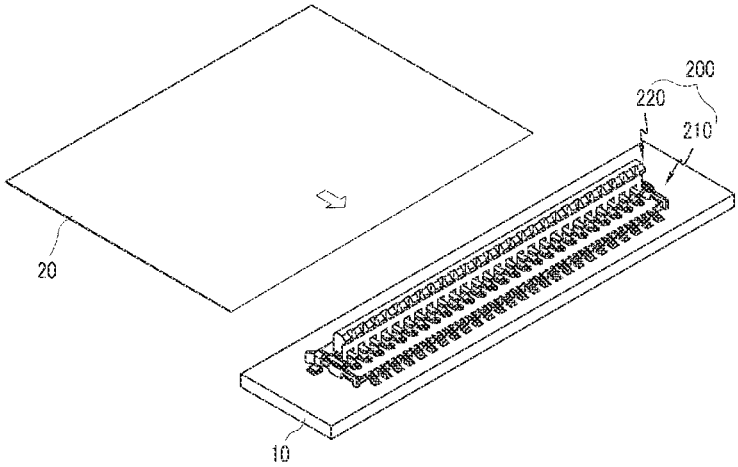
FIG. 8 is an oblique view of the insertion of an FPC into the flexible cable connector of this invention according to Embodiment 2.
Figure 9:
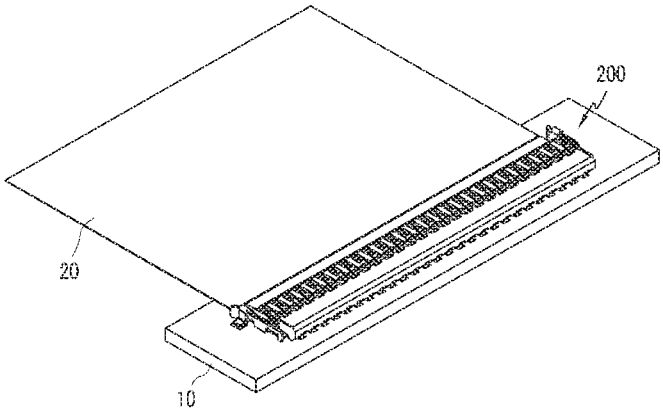
FIG. 9 is an oblique view of an FPC having been inserted into the flexible cable connector of this invention according to Embodiment 2.

FIG. 8 is an oblique view of the insertion of an FPC into the flexible cable connector of this invention according to Embodiment 2; FIG. 9 is an oblique view of an FPC having been inserted into the flexible cable connector of this invention according to Embodiment 2.

The flexible cable connector (200) according to this embodiment comprises: a housing (210) that is soldered to a PCB (10) and forms an insertion space between it and the PCB (10) into which an FPC (20) is inserted; and an actuator (220) that is mounted rotatably on the housing (210) so as to press down on the top surface of the FPC (20) inserted into the insertion space so as to establish a direct contact between the FPC (20) and the PCB (10).

The flexible cable connector (200) according to this embodiment has a back-flip type structure; the actuator (220) is closed by rotating toward the front of the housing (210), and the FPC (20) is inserted via the back of the housing (210).

As shown in FIG. 8, when the actuator (220) has been opened, the FPC (20) is inserted into or removed from the insertion space via the back of the housing (210). The actuator (220) is vertical when opened.

As shown in FIG. 9, after the FPC (20) has been fully inserted into the insertion space, if the actuator (220) is closed by rotating it toward the front of the housing (210), the FPC (20) is then firmly fixed in place within the insertion space, and the FPC (20) is brought into close contact with the top surface of the PCB (10) as each of its contact pins are brought into direct contact.

Figure 10:
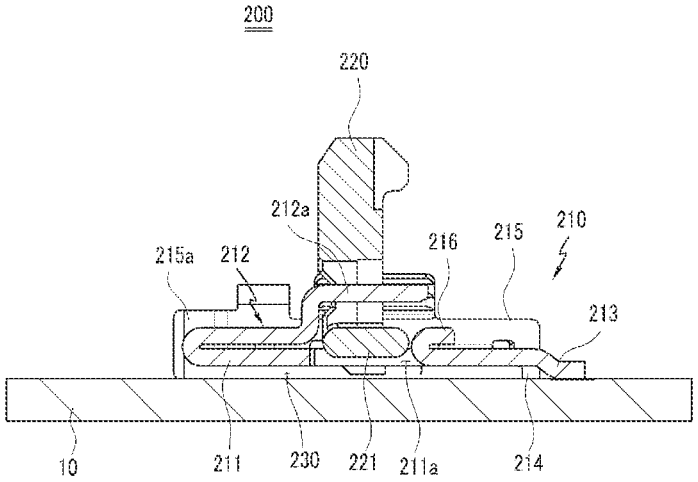
FIGS. 10 through 12 are cross-sections showing the process of the FPC being inserted in accordance with Embodiment 2 of this invention.
Figure 11:
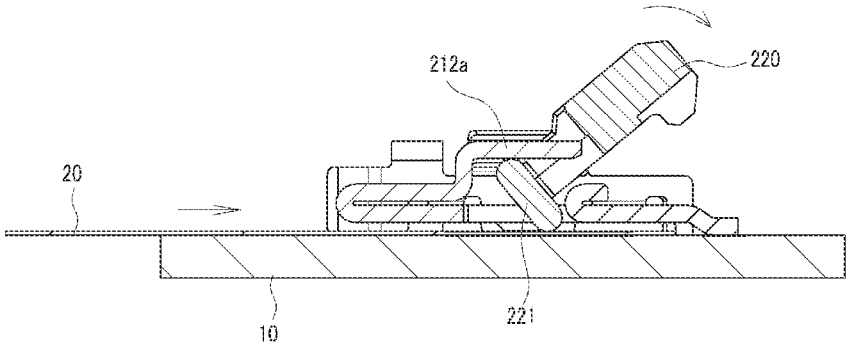
Figure 12:
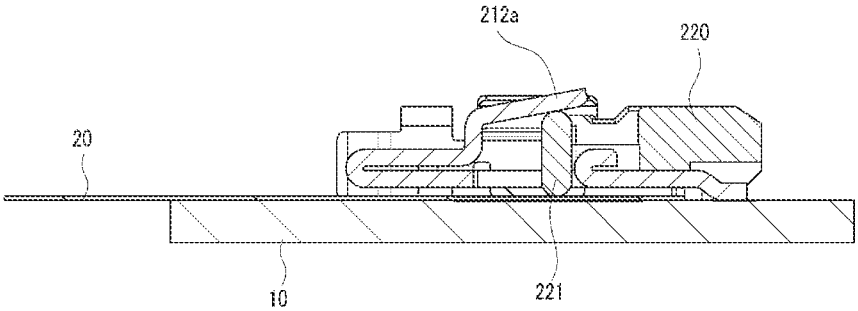

FIGS. 10 through 12 are cross-sections showing the process of the FPC being inserted in accordance with Embodiment 2 of this invention.

The flexible cable connector (200) of this invention comprises a housing (210) formed of metal, and an actuator (220) formed of an insulator such as plastic. The housing (210) comprises a lower surface part (211), axle support part (212), soldering part (213), FPC stopper part (214), fitting part (215), and axle detachment prevention part (216). Axles (221) are furnished in the actuator (220).

The flexible cable connector (200) according to this embodiment is formed so that the insertion space (230) formed between the lower surface part (211) of the housing (210) and the PCB (10) is open toward the back of the housing (210). To this end, the soldering part (213) soldered to the PCB (10) is formed separately from the front end of the lower surface part (211), and the FPC stopper part (214) that restricts the insertion of the FPC (20) is also formed separately from the front of the lower surface part (211).

The guide part (111*b*) formed on the front end of the lower surface part (111) in Embodiment 1 is not formed in this embodiment. Specifically, no separate guide part is configured because the axle support part (212) is bent and extended from the back end of the lower surface part (211), and the bent portion forms a curve, so that when the FPC (20) is inserted into the back of the housing (210), the FPC (20) can be inserted easily and without damage.

In Embodiment 1, a guide part (115*b*) was formed on the front end of the fitting part (115), but in this embodiment, the guide part (215*a*) is formed on the back end of the fitting part (215).

The process of inserting an FPC (20) into a flexible cable connector (200) of this invention, having the above-described configuration, will now be described with reference to FIGS. 10 through 12.

As shown in FIG. 10, when the actuator (220) is in vertical position, the long parts of the axles (221) are in a horizontal position within the axle through-holes (211*a*), and the insertion space (230) is entirely open.

As shown in FIG. 11, the FPC (20) is inserted into the insertion space (230) via the rear of the housing (210), and the front end of the FPC (20) is inserted until it cannot be inserted any further due to contacting the FPC stopper part (214). When the FPC (20) has been fully inserted, the actuator (220) is rotated toward the front of the housing (210). In this process, the axles (221) of the actuator (220) rotate while being supported by the support beams (212*c*) of the axle support parts (212) so that they cannot detach upward.

As shown in FIG. 12, if the actuator (220) is completely closed, the long parts of the axles (221) become vertical, and one end of the long part pushes on the top surface of the FPC (20), while the other end is pushed by the support beam (212*a*). The axle (221) is pushed downward by the elastic force of the support beam (212*c*), so that the FPC (20) is pushed into close contact with the top surface of the PCB (10), which causes the contact pins of the FPC (20) to directly contact the contact pins of the PCB (10).

Hereinabove, a description has been given of the flexible cable connector of this invention, based on preferred embodiments; however, this invention is not limited to specific embodiments, and a person having ordinary skill in the art of the relevant field can modify these embodiments in various ways without departing from the scope disclosed in the claims.

What is claimed is:

1. A flexible cable connector which is configured to connect a flexible cable to a printed circuit board (PCB), whereby a conductor part on a bottom of the flexible cable is put into direct contact with a conductor part on a top of the PCB, the flexible cable connector comprising:

a housing, the housing being secured to the PCB, the housing having a lower surface part having front and back end portions, the lower surface part being positioned at an interval from the top of the PCB, wherein an insertion space is defined between the lower surface part, which defines an upper boundary of the insertion space, and the top of the PCB, which defines a lower boundary of the insertion space, such that an insertion opening of the insertion space is defined, the insertion space being configured to receive the flexible cable therein via the insertion opening; and an actuator, the actuator being rotatably mounted on the housing, the actuator including first and second opposite end portions, the second end portion of the actuator including at least one axle, the at least one axle being positioned between the front and back end portions of the lower surface part, the actuator configured to be moved from an open position to a closed position by rotating the first end portion thereof toward a front of the housing, the actuator configured to be moved from the closed position to the open position by rotating the first end portion thereof away from the front of the housing, and wherein, when the actuator is in the closed position, a part of the at least one axle pushes downward on the inserted flexible cable.

2. The flexible cable connector according to claim 1, wherein the housing is formed of metal.

3. The flexible cable connector according to claim 1, wherein the at least one axle of the actuator is formed with a shape that is long in the vertical direction and short in the front-back direction when the actuator is in the closed position.

4. The flexible cable connector according to claim 1, wherein the housing is furnished with a rotation prevention structure that prevents any more rotation than necessary of the actuator toward the back of the housing when the actuator is moved from the closed position to the open position.

5. The flexible cable connector according to claim 1, wherein the lower surface part has at least one axle through-hole formed therethrough between the front and back end portions from a top thereof to a bottom thereof so that the at least one axle can pass through, and wherein the housing has at least one support beam which is at least partially positioned above the at least one axle through-hole, the at least one support beam being furnished to provide elastic support by pressing downward on the at least one axle when the actuator is in the closed position.

6. The flexible cable connector according to claim 5, wherein a plurality of axles and support beams are provided, and wherein each support beam individually provides elastic support to a corresponding axle.

7. The flexible cable connector according to claim 6, wherein the insertion opening is provided at one of the front of the housing and a back of the housing.

8. The flexible cable connector according to claim 7, wherein the housing has a stopper part which is positioned opposite the insertion opening to restrict the insertion of the flexible cable in the insertion space.

9. The flexible cable connector according to claim 8, wherein the insertion opening is provided at the back of the housing, and the housing further comprises:

an axle support part bent upward from a back end of the lower surface part so as to overlap with the lower surface part, each support beam being formed on an end of the axle support part;

a soldering part wherein the front end of the lower surface part is separated and soldered to the PCB;

the stopper part, formed by separating the front end of the lower surface part; and a fitting part that covers a side of the insertion space and is soldered to the PCB, formed as a single unit with both sides of the lower surface part respectively.

10. The flexible cable connector according to claim 8, wherein the insertion opening is provided at the front of the housing, and the housing further comprises:

an axle support part bent upward from a back end of the lower surface part so as to overlap with the lower surface part, each support beam being formed on an end of the axle support part;

a soldering part wherein the back end of the lower surface part or part of the axle support part is separated and soldered to the PCB;

the stopper part, formed by separating the back end of said lower surface part or part of the axle support part; and a fitting part that covers a side of the insertion space and is soldered to the PCB, formed as a single unit with both sides of the lower surface part respectively.

11. The flexible cable connector according to claim 10, wherein an outward-sloping guide part is formed on the front end of the fitting part.

12. The flexible cable connector according to claim 10, wherein on a front end of the lower surface part, an upward-tilted guide part is formed.

13. The flexible cable connector according to claim 10, wherein a free end of each support beam is positioned facing the front of the housing, and on a front part of the at least one axle through-hole, an axle detachment prevention part is formed that prevents forward detachment of the axles, by bending upward from the lower surface part so as to overlap.

14. A flexible cable connector which is configured to connect a flexible cable to a printed circuit board (PCB), whereby a conductor part on a bottom of the flexible cable is put into direct contact with a conductor part on a top of the PCB, the flexible cable connector comprising:

a housing, the housing including a lower surface part, an axle support part, a soldering part, a stopper part, and a pair of fitting parts, wherein the lower surface part is positioned at an interval from the top of the PCB, the lower surface part having at least one axle through-hole formed therethrough from a top of the lower surface part to a bottom of the lower surface part, the axle support part is bent upward from a back end of the lower surface part so as to overlap with the lower surface part, the axle support part defining a plurality of spaced-apart support beams on an end thereof, each support beam being at least partially positioned above the at least one axle through-hole of the lower surface part, the soldering part formed from one of the back end of the lower surface part and the axle support part, the soldering part configured to be positioned against, and soldered to, the PCB, the stopper part formed from one of the back end of the lower surface part and the axle support part, the stopper part configured to extend downwardly from the lower surface part toward the top of the PCB, the fitting parts are provided on opposite sides of the lower surface part, each fitting part configured to be positioned against, and soldered to, the PCB, an insertion space is defined between the lower surface part, the stopper part, the fitting parts, and the top of the PCB such that an insertion opening is defined at a front of the housing, the insertion space being configured to receive the flexible cable therein via the insertion opening; and an actuator, the actuator being rotatably mounted on the housing, the actuator including first and second opposite end portions, the second end portion of the actuator including a plurality of axles, the actuator configured to be moved from an open position to a closed position by rotating the first end portion thereof toward the front of the housing, the actuator configured to be moved from the closed position to the open position by rotating the first end portion thereof away from the front of the housing, wherein during rotation of the actuator, the axles pass through the at least one axle through-hole of the lower surface part, and wherein, when the actuator is in the closed position, a part of each axle pushes downward on the inserted flexible cable and the support beams provide elastic support by pressing downward on the axles.

15. The flexible cable connector according to claim 14, wherein an outward-sloping guide part is formed on a front end of each fitting part.

16. The flexible cable connector according to claim 14, wherein an upward-tilted guide part is formed on a front end of the lower surface part.

17. The flexible cable connector according to claim 14, wherein a free end of each support beam is positioned facing the front of the housing.

18. The flexible cable connector according to claim 14, wherein an axle detachment prevention part is formed forward of the at least one axis through-hole, the axle detachment prevention part being formed by bending and overlapping a portion of the lower surface part.

19. The flexible cable connector according to claim 14, wherein each axle is formed with a shape that is long in a vertical direction and short in a front-back direction when the actuator is in the closed position.

20. A flexible cable connector which is configured to connect a flexible cable to a printed circuit board (PCB), whereby a conductor part on a bottom of the flexible cable is put into direct contact with a conductor part on a top of the PCB, the flexible cable connector comprising:

a housing, the housing including a lower surface part, an axle support part, a soldering part, a stopper part, and a pair of fitting parts, wherein the lower surface part is positioned at an interval from the top of the PCB, the lower surface part having at least one axle through-hole formed therethrough from a top of the lower surface part to a bottom of the lower surface part, the axle support part is bent upward from a back end of the lower surface part so as to overlap with the lower surface part, the axle support part defining a plurality of spaced-apart support beams on an end thereof, each support beam being at least partially positioned above the at least one axle through-hole of the lower surface part, the soldering part formed from a front end of the lower surface part, the soldering part configured to be positioned against, and soldered to, the PCB, the stopper part formed from the front end of the lower surface part, the stopper part configured to extend downwardly from the lower surface part toward the top of the PCB, the fitting parts are provided on opposite sides of the lower surface part, each fitting part configured to be positioned against, and soldered to, the PCB, an insertion space is defined between the lower surface part, the stopper part, the fitting parts, and the top of the PCB such that an insertion opening is defined at a back of the housing, the insertion space being configured to receive the flexible cable therein via the insertion opening; and an actuator, the actuator being rotatably mounted on the housing, the actuator including first and second opposite end portions, the second end portion of the actuator including a plurality of axles, the actuator configured to be moved from an open position to a closed position by rotating the first end portion thereof toward the front of the housing, the actuator configured to be moved from the closed position to the open position by rotating the first end portion thereof away from the front of the housing, wherein during rotation of the actuator, the axles pass through the at least one axle through-hole of the lower surface part, and wherein, when the actuator is in the closed position, a part of each axle pushes downward on the inserted flexible cable and the support beams provide elastic support by pressing downward on the axles.

21. The flexible cable connector according to claim 20, wherein an outward-sloping guide part is formed on a back end of each fitting part.

22. The flexible cable connector according to claim 20, wherein a free end of each support beam is positioned facing the front of the housing.

23. The flexible cable connector according to claim 20, wherein an axle detachment prevention part is formed forward of the at least one axis through-hole, the axle detachment prevention part being formed by bending and overlapping a portion of the lower surface part.

24. The flexible cable connector according to claim 20, wherein each axle is formed with a shape that is long in a vertical direction and short in a front-back direction when the actuator is in the closed position.

* * * * *